US007127377B2

(12) United States Patent
Huang et al.

(10) Patent No.: US 7,127,377 B2
(45) Date of Patent: Oct. 24, 2006

(54) MONITORING SYSTEMS AND METHODS THEREOF

(75) Inventors: Chien-Ping Huang, Taoyuan (TW); Hsin-Dar Tang, Miaoli (TW)

(73) Assignee: Industrial Technology Research Institute, Hsinchu (TW)

( * ) Notice: Subject to any disclaimer, the term of this patent is extended or adjusted under 35 U.S.C. 154(b) by 9 days.

(21) Appl. No.: 11/014,960

(22) Filed: Dec. 20, 2004

(65) Prior Publication Data

US 2005/0216229 A1 Sep. 29, 2005

(30) Foreign Application Priority Data

Mar. 24, 2004 (TW) ..... 93107898 A

(51) Int. Cl.
*G06F 11/00* (2006.01)
*G06F 15/00* (2006.01)
*G06F 1/00* (2006.01)

(52) U.S. Cl. ..... 702/188; 702/47; 702/182

(58) Field of Classification Search ..... 702/182, 702/138, 116, 100, 98, 84, 81, 47, 55, 45, 702/188; 62/133, 128, 151, 156, 278; 700/274, 700/275, 282; 454/237–239, 254–256; 73/19.04, 73/19.05, 195–196, 198
See application file for complete search history.

(56) References Cited

U.S. PATENT DOCUMENTS 5,551,419 A * 9/1996 Froehlich et al. ..... 128/204.23
5,938,527 A * 8/1999 Oshima et al. ..... 454/344

* cited by examiner

*Primary Examiner*—Bryan Bui
(74) *Attorney, Agent, or Firm*—Birch, Stewart, Kolasch & Birch, LLP

(57) ABSTRACT

A monitoring method to monitor efficiency of air-blowing devices in a ventilation system. First, an optimal system curve is provided. Then, the air-blowing devices are activated with a first current frequency to obtain a first fan performance curve of the air-blowing devices according to the first current frequency and a test record. Next, first flow rates of the air-blowing devices are detected, and first system curves and efficiencies of the air-blowing devices are obtained by comparing the first flow rates with the first fan performance curve.

24 Claims, 9 Drawing Sheets

MONITORING SYSTEMS AND METHODS THEREOF

BACKGROUND

The invention relates to monitoring methods, and particularly to methods of monitoring efficiency of air-blowing devices.

FIG. 1 shows a conventional air-blowing device 100, which connects to an equipment 300 with a pipe 110 and to a stack 200 with a pipe 120. Fume exhaust gas in the equipment 300 is drawn by air-blowing device 100, and exhausted through the pipe 110, pipe 120, and the stack 200.

When a factory is built, air-blowing device performance (flow rate, pressure drop etc.) exactly fit the air-blowing requirement of the factory, according to the quantity of fume exhaust gas produced. As all equipments in the factory operate simultaneously, the air-blowing devices are activated with highest current frequency and optimal efficiency. However, the equipment do not always all operate simultaneously. When some of the equipment shuts down, the amount of fume exhaust gas decreases, and the activating current frequency should decrease accordingly to reduce energy consumption and improve operating efficiency.

However, adjustment of the activating current frequency cannot achieve high efficiency without feedback control. FIG. 1*b* shows air-blowing devices 100, 100' and 100", disposed in a ventilation system. Air-blowing devices 100, 100' and 100" remove fume exhaust gas from the equipment 300 through the pipe 110 (comprising pipes 111, 112, and 113) and the stack 200. However, distances between the pipe 111 and the air-blowing devices 100, 100' and 100" are different; thus, the operating efficiencies of the air-blowing devices are different. For example, air-blowing device 100 may have better efficiency than air-blowing devices 100'. Therefore, to improve efficiency, the activating current frequency of the air-blowing devices should be adjusted separately according to feedback monitoring information.

SUMMARY

Monitoring methods to monitor efficiency of air-blowing devices in a ventilation system are provided. First, an optimal system curve is provided. Then, the air-blowing devices are activated with a first current frequency to obtain a first fan performance curve of the air-blowing devices according to the first current frequency and a test record. Next, first flow rates of the air-blowing devices are detected, and first system curves and efficiencies of the air-blowing devices are obtained by comparing the first flow rates with the first fan performance curve.

The invention improves efficiency of air-blowing devices to reduce energy consumption and cost in any boundary condition.

DESCRIPTION OF THE DRAWINGS

The invention can be more fully understood by reading the subsequent detailed description and examples with references made to the accompanying drawings, wherein.

DETAILED DESCRIPTION

Figure 1A:
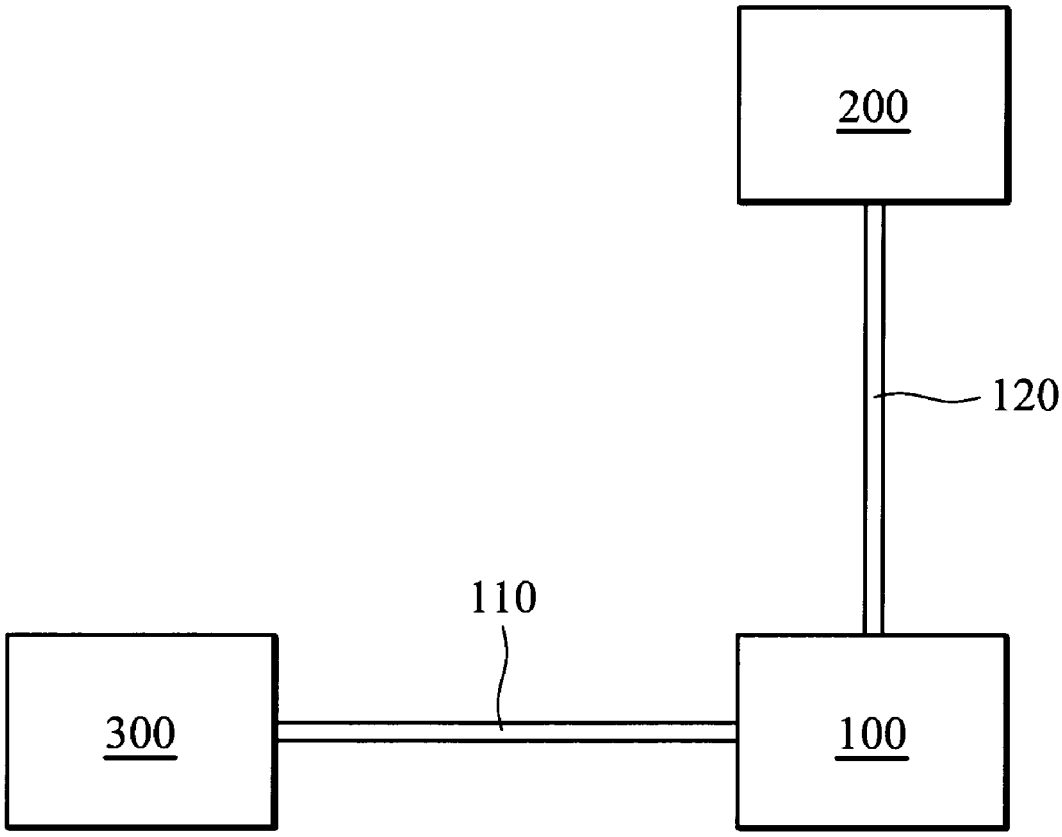
FIG. 1a (RELATED ART)
FIG. 1*a* shows the main structure of a conventional ventilation system.
Figure 1B:
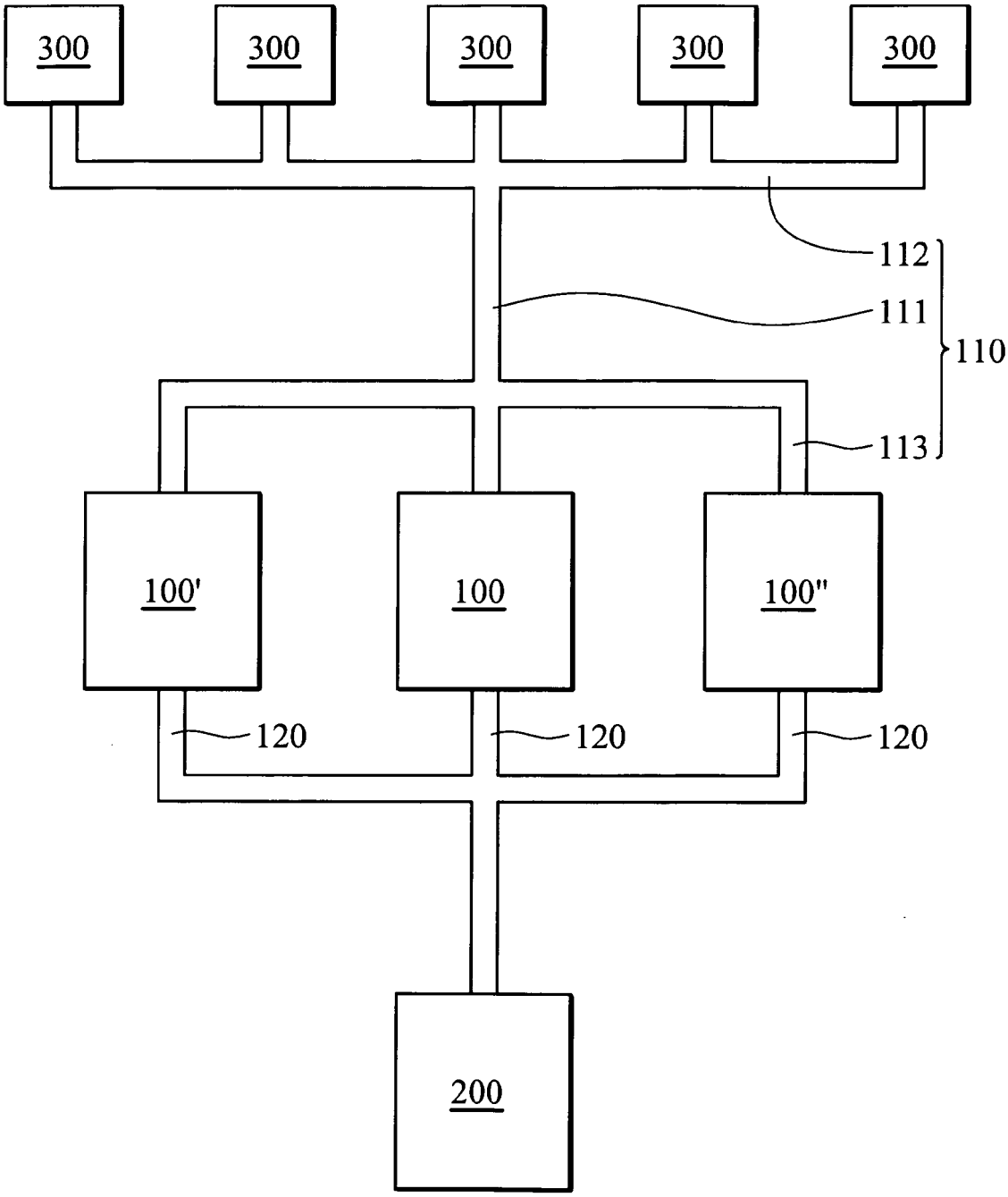
FIG. 1b (RELATED ART)
FIG. 1*b* shows the complete structure of a conventional ventilation system.
Figure 2A:
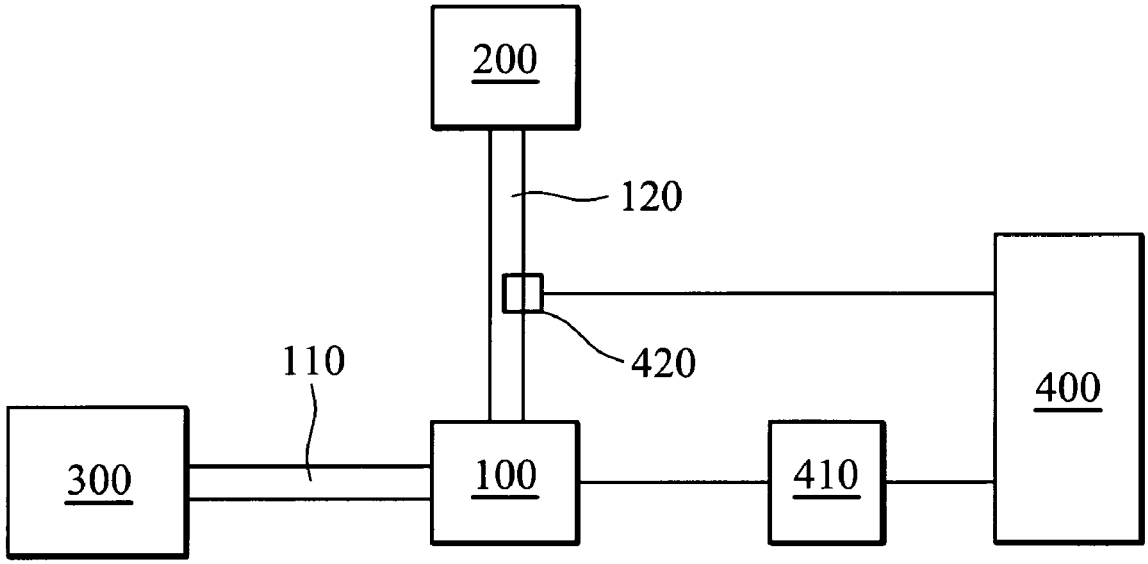
FIG. 2*a* shows a simplified monitoring system of the first embodiment.

FIG. 2*a* shows a simplified monitoring system of a first embodiment comprising a control box 410, a flow rate sensor 420 and a controller 400. The control box 410 activates the air-blowing device 100 with a current frequency. The flow rate sensor 420 detects a flow rate in a pipe 120. The controller 400 is coupled with the control box 410 and the flow rate sensor 420, and controls the current frequency according to the flow rate. The air-blowing device 100 is a centrifugal fan, which exhausts fume gas from the equipment 300, through the pipe 110, pipe 120 and the stack 200.

Figure 2B:
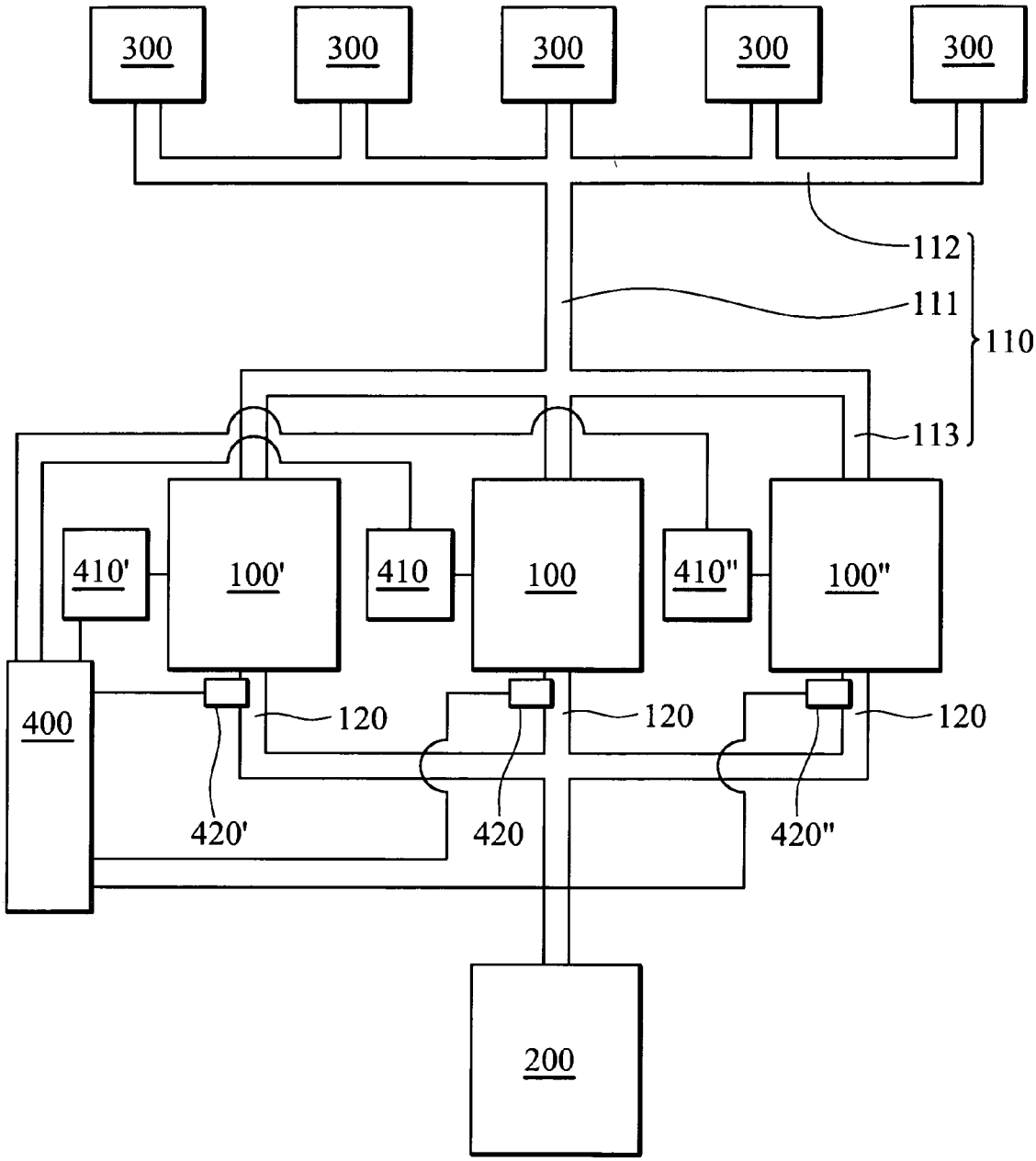
FIG. 2*b* shows a complete monitoring system of the first embodiment.

FIG. 2*b* shows a complete monitoring system of the first embodiment which further comprises air-blowing devices 100' and 100", flow rate sensors 420' and 420" and control boxes 410' and 410". The pipe 110 comprises pipes 111, 112, and 113. The air-blowing devices 100' and 100" are farther from the pipe 111 than the air-blowing device 100.

Figure 3:
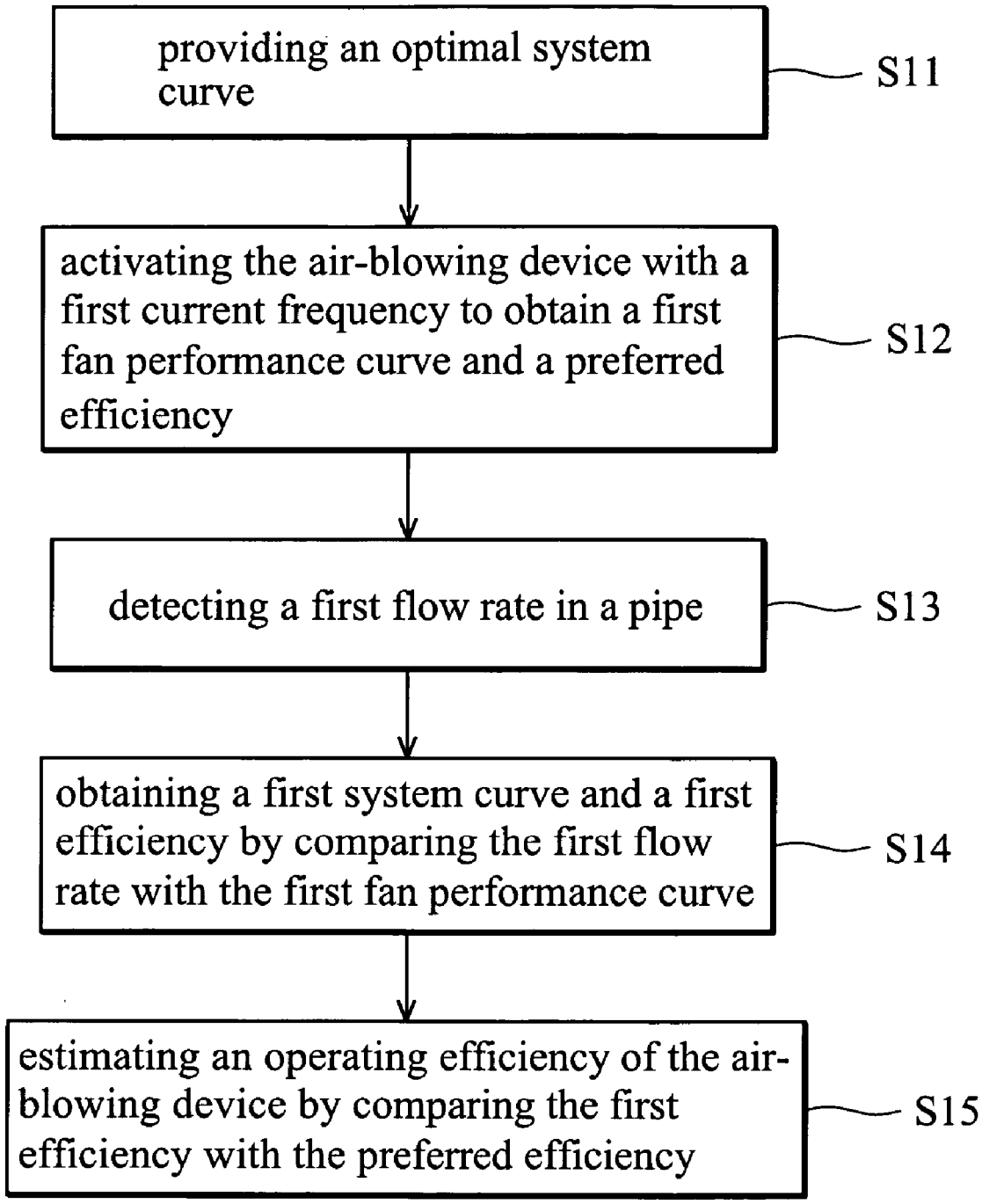
FIG. 3 is a flowchart of the first embodiment.

FIG. 3 is a flowchart of the first embodiment. Because the air-blowing devices are controlled separately, the description hereafter describes the control method of a single air-blowing device 100; as well, the definitions of the following terms, such as "optimal system curve", are described in the next paragraph. With reference to FIG. 5 simultaneously, first, an optimal system curve 11 is provided (S11). Then, the air-blowing device is activated with a first current frequency to obtain a first fan performance curve 10 of the air-blowing device according to the first current frequency and a test record, and obtain a preferred efficiency of the air-blowing device by comparing the first fan performance curve 10 with the optimal system curve 11 (S12). Next, a first flow rate of the air-blowing device is detected (S13), and a first system curve and first efficiency of the air-blowing device is obtained by comparing the first flow rate with the first fan performance curve 10 (S14). Finally, an operating efficiency of the air-blowing device is estimated by comparing the first efficiency with the preferred efficiency (S15).

Figure 4:
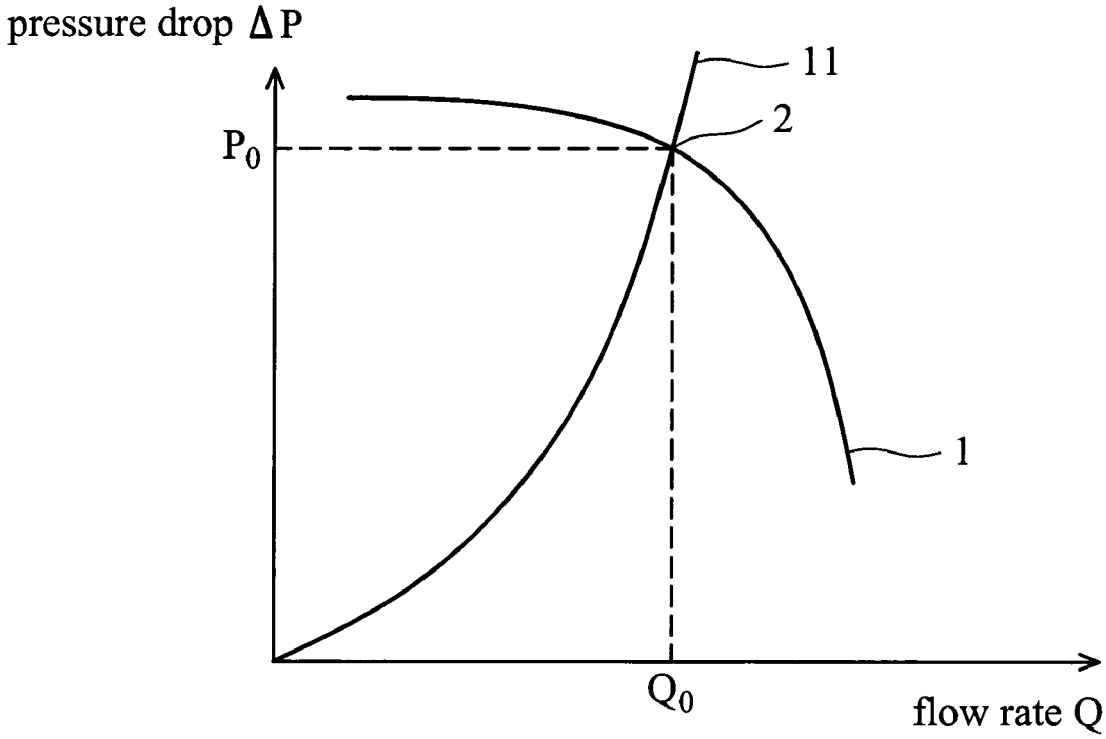
FIG. 4 shows the system curve of the air-blowing device activated with the highest current frequency.

The definitions of the optimal system curve 11 and the first fan performance curve 10 are described as follows. When a factory is built, as shown in FIG. 4, a predicted flow rate ($Q_0$) and a predicted pressure drop ($P_0$) are determined according the number of equipment and a layout of the pipes. Next, a constant $K_0$ is obtained by substituting the predicted flow rate $Q_0$ and the predicted pressure $P_0$ into formula $P_0=K_0\times Q_0^2$. Thus, the optimal system curve 11 is obtained from formula $P=K_0\times Q^2$.

Fan performance curve presents the performance of the air-blowing device under a specific activating current frequency. For example, with reference to FIG. 4, when all air-blowing devices rotate in the highest current frequency, the pressure and the flow rate in the pipes equals the predicted flow rate ($Q_0$) and the predicted pressure drop ($P_0$), and a predicted operating point 2 is achieved. According to a test report of the air-blowing device provided by the manufacturer thereof, a fan performance curve 1 of the air-blowing device under the highest current frequency is obtained. The fan performance curve 1 of the air-blowing devices overlaps the predicted operating point 2, and the fan performance curve 1 is defined as a predicted fan performance curve of the ventilation system.

Figure 5A:
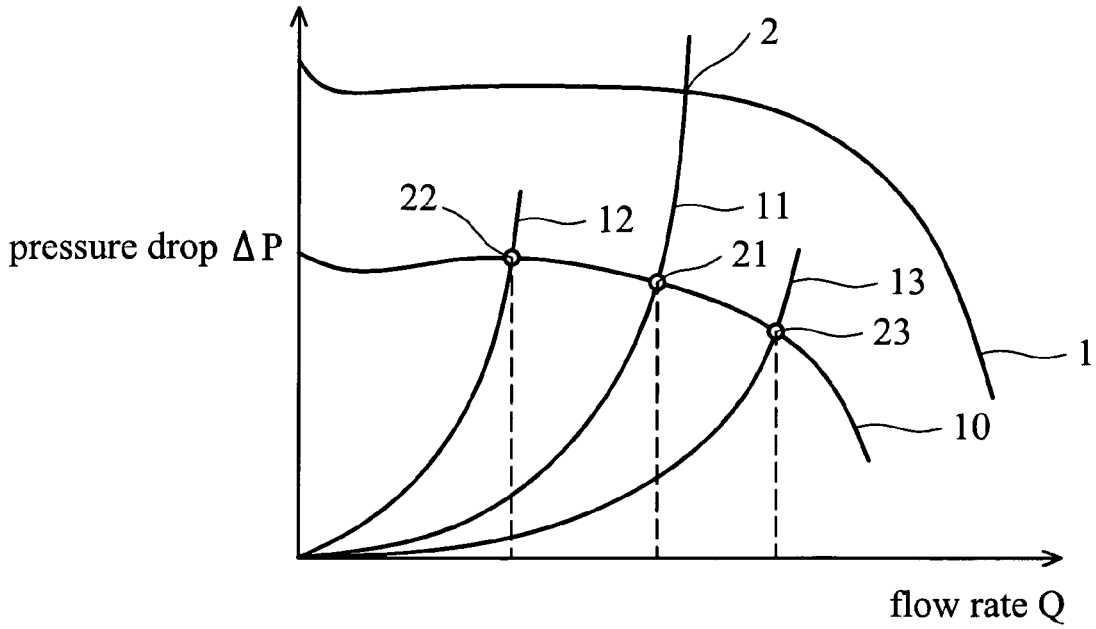
FIG. 5*a* shows the system curves of the air-blowing device activated with a lower current frequency.

Thus, as to the first fan performance curve 10, as shown in FIGS. 5*a* and 2*a*, when the air-blowing device 100 rotates under a first current frequency (a lower current frequency than the highest), the air-blowing device's performance meets a first fan performance curve 10. The first fan performance curve 10 is achieved from Fan's law and the predicted fan performance curve 1 or from the test record provided by air-blowing device's manufacturer.

The efficiency estimation method of the air-blowing device is described hereafter. First, a first flow rate Q in the pipe 120 corresponding to the air-blowing device 100 is detected. A first operating point of the air-blowing device is achieved by comparing the first flow rate Q with the first fan performance curve 10. As the boundary conditions (for example: layout of the pipe) of the air-blowing devices differ from each other, the locations of the first operating point vary. When the first operating point is at a point 22 on a system curve 12, the air-blowing device rotates unstable for excessive different flow rates in the similar pressure drop. When the first operating point is at a point 23 on a system curve 13, the air-blowing device has reduced efficiency. When the first operating point is at a point 21 on the optimal system curve 11, the air-blowing device has a preferred efficiency. Herein, the preferred efficiency means the operating efficiency of the air-blowing device when the operating point is on the optimal system curve. The operating condition of the air-blowing device 100 (in unstable, low efficiency or optimal condition) is achieved by estimating the distance between the first operation point and the optimal system curve 11.

Figure 5B:
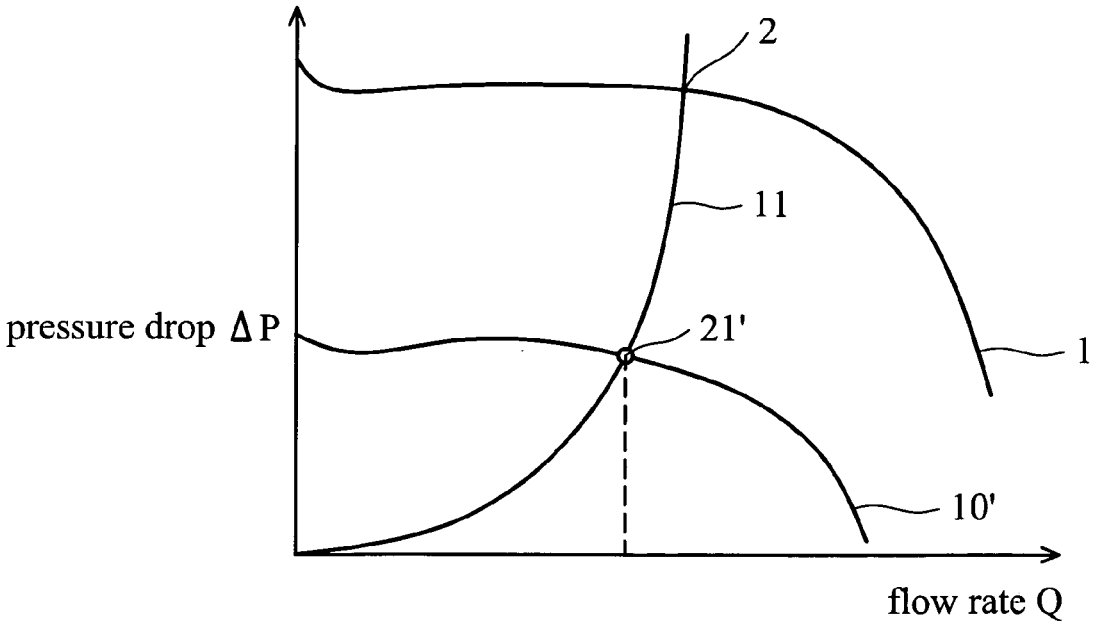
FIG. 5*b* shows the system curve of the air-blowing device activated with a preferred current frequency.

Then, by controlling the activating current frequency, the first operating point nears or is located on the optimal system curve 11 to improve the operating efficiency. For example, as shown in FIG. 5*b*, after estimating, the controller activates the air-blowing device 100 with a preferred current frequency; thus, a preferred fan performance curve 10' is provided, and an operating point 21' of the air-blowing device 100 falls on the optimal system curve 11. In other words, by controlling the activating current frequency of the air-blowing device, operating efficiency of the air-blowing device nears to a preferred efficiency.

As to the efficiency calculation, a voltage input (V), a current input (A) and an exhaust flow rate (Q) of each air-blowing device is obtained in operation. Then, with reference FIG. 5, a pressure drop (P) is obtained by comparing the flow rate (Q) with the first fan performance curve 10. Thus, the efficiency η of the air-blowing device is obtained from formula $$\eta = \frac{P \times Q}{K_e \times I \times V},$$

wherein Ke is a constant.

Because the boundary conditions differ, the air-blowing devices 100, 100' and 100" have different preferred activating current frequencies. However, though the boundary conditions differ, the air-blowing devices are monitored by the same monitoring method.

Figure 6:
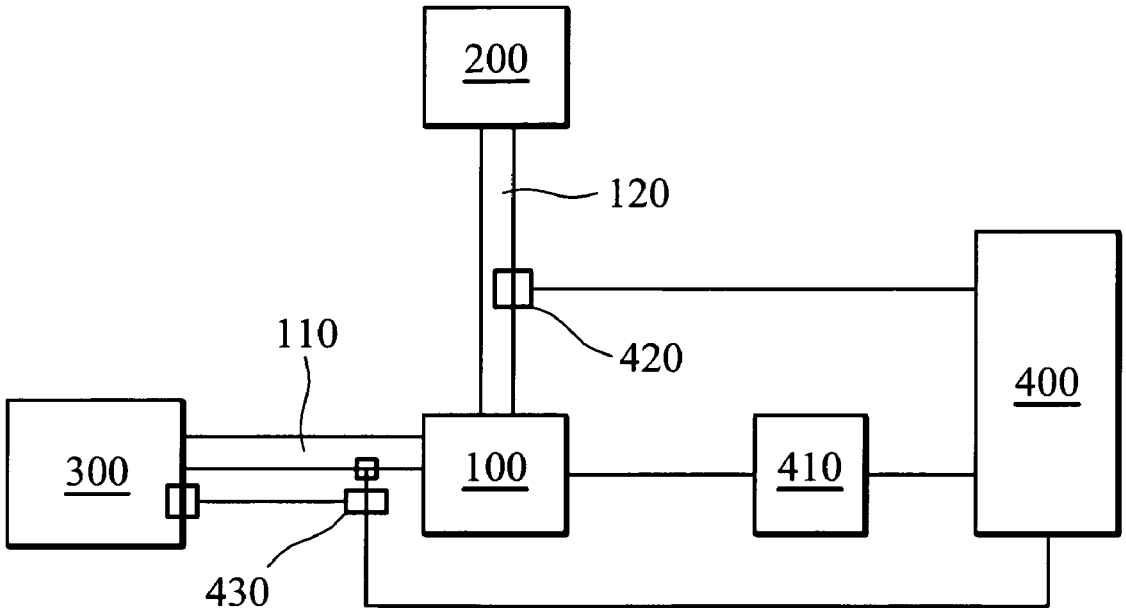
FIG. 6 shows a monitoring system of a second embodiment.

FIG. 6 shows a simplified monitoring system of a second embodiment which further comprises a pressure sensor 430 for sensing a pressure drop at an inlet port of the air-blowing device 100. The pressure sensor 430 is coupled with the controller 400. The controller 400 controls the first current frequency according to the flow rate and the pressure drop detected.

Figure 7:
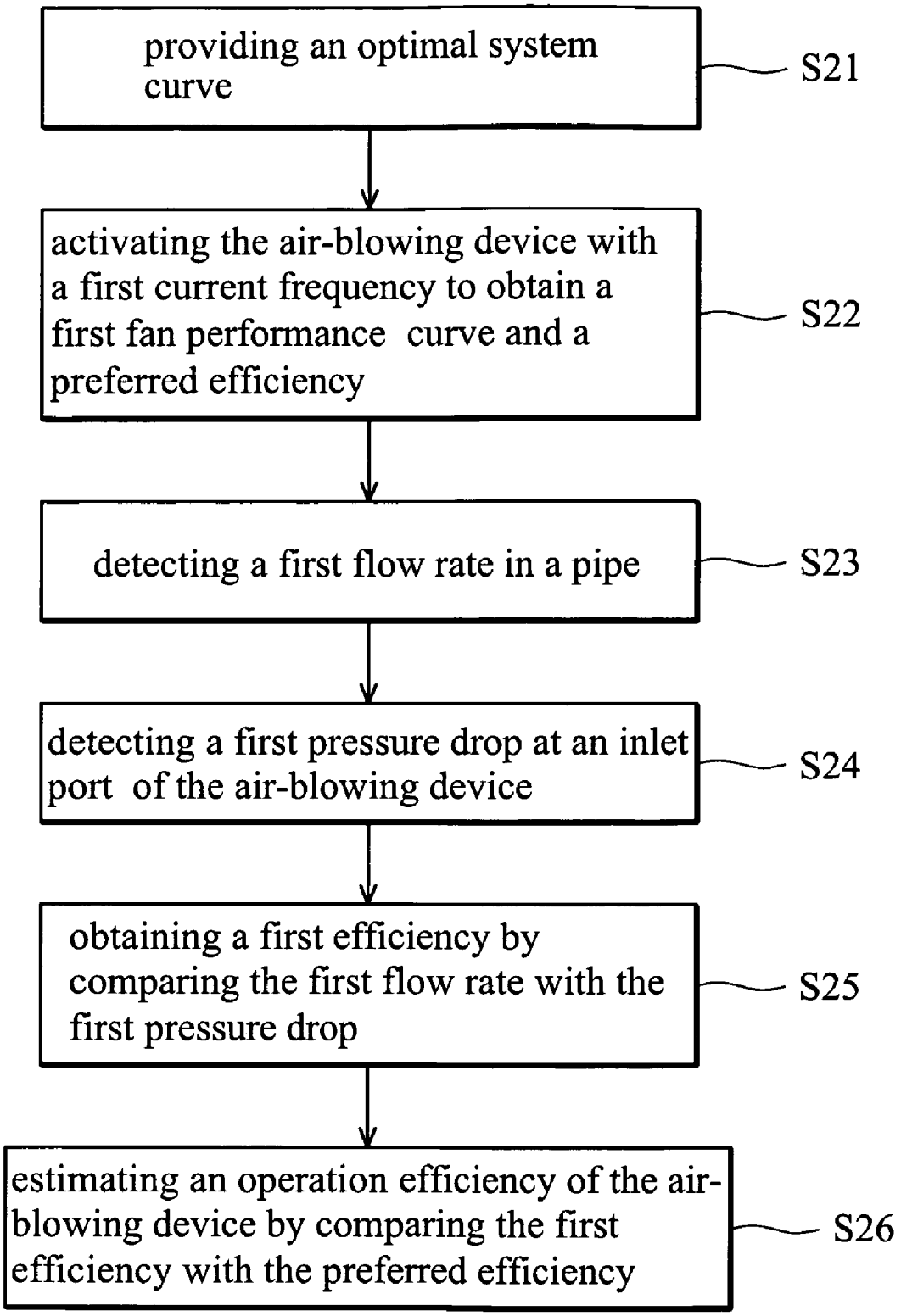
FIG. 7 is a flowchart of the second embodiment.

FIG. 7 is a flowchart of the second embodiment. With reference to FIG. 5 simultaneously, first, an optimal system curve 11 is provided (S21). Then, the air-blowing device is activated with a first current frequency to obtain a first fan performance curve 10 of the air-blowing device according to the first current frequency and a test record, and obtain a preferred efficiency of the air-blowing device by comparing the first fan performance curve 10 with the optimal system curve 11 (S22). Next, a first flow rate of the air-blowing device is detected (S23), and a first pressure drop at inlet port thereof is also detected (S24). Then, first efficiency of the air-blowing device is obtained by comparing the first flow rate with the first pressure drop (S25). Finally, operating efficiency of the air-blowing device is estimated by comparing the first efficiency with the preferred efficiency (S26).

The first embodiment differs from the second embodiment in the achievement of the first efficiency. The second embodiment obtains the first efficiency of the air-blowing device by comparing the first flow rate with the first pressure drop (S25). However, the first embodiment obtains the first efficiency by comparing the first flow rate with the first fan performance curve (S14). Because accurate detection of the first pressure drop is difficult, the first efficiency achieved in the first embodiment is more accurate.

The invention improves the efficiency of the air-blowing device to reduce energy consumption and cost in any boundary condition.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for monitoring operating efficiency of an air-blowing device in a ventilation system, comprising:

providing an optimal system curve;

activating the air-blowing device with a first current frequency, obtaining a first fan performance curve of the air-blowing device according to the first current frequency and a test record, and obtaining a preferred efficiency of the air-blowing device by comparing the first fan performance curve with the optimal system curve;

detecting a first flow rate of the air-blowing device;

obtaining a first system curve and a first efficiency by comparing the first flow rate to the first fan performance curve;

estimating an operating efficiency of the air-blowing device by comparing the first efficiency with the preferred efficiency; and outputting a preferred fan performance curve and operating point.

2. The method as claimed in claim 1, wherein the optimal system curve is achieved from a predicted flow rate $Q_0$ and a predicted pressure drop $P_0$.

3. The method as claimed in claim 2, wherein the optimal system curve is achieved by following steps:

obtaining a constant $K_0$ by substituting the predicted flow rate $Q_0$ and the predicted pressure drop $P_0$ into formula $P_0=K_0\times Q_0^2$; and achieving the optimal system curve from formula $P=K^0\times Q^2$ wherein P represents pressure drop and Q represents flow rate.

4. The method as claimed in claim 1, further comprising controlling an activating current frequency of the air-blowing device to bring an operating efficiency thereof to a preferred efficiency.

5. The method as claimed in claim 1, wherein the air-blowing device is a centrifugal fan.

6. A method for monitoring an operating efficiency of an air-blowing device in a ventilation system, comprising:

providing an optimal system curve;

detecting a first flow rate of the air-blowing device;

activating the air-blowing device with a first current frequency, obtaining a first fan performance curve of the air-blowing device according to the first current frequency and a test record, and obtaining a preferred efficiency of the air-blowing device by comparing the first fan performance curve with the optimal system curve;

detecting a first pressure drop at an inlet port of the air-blowing device;

obtaining a first efficiency by comparing the first flow rate with the first pressure drop;

estimating an operating efficiency of the air-blowing device by comparing the first efficiency with the preferred efficiency; and outputting a preferred fan performance curve and operating point.

7. The method as claimed in claim 6, wherein the optimal system curve is achieved from a predicted flow rate $Q_0$ and an predicted pressure drop $P_0$.

8. The method as claimed in claim 7, wherein the optimal system curve is achieved by following steps:

obtaining a constant $K_0$ by substituting the predicted flow rate $Q_0$ and the predicted pressure drop $P_0$ into formula $P_0=K_0\times Q_0^2$; and achieving the optimal system curve from formula $P=K_0\times Q^2$, wherein P represents pressure drop and Q represents flow rate.

9. The method as claimed in claim 6, further comprising controlling an activating current frequency of the air-blowing device to bring an operating efficiency thereof to the preferred efficiency.

10. The method as claimed in claim 6, wherein the air-blowing device is a centrifugal fan.

11. A system for monitoring an operating efficiency of an air-blowing device in a ventilation system, comprising:

a control box, activating the air-blowing device;

a flow rate sensor, detecting flow rate of the air-blowing device;

a controller, coupled with the control box and the flow rate sensor, and controlling a current frequency of the air-blowing device according to the flow rate; and wherein the controller pre-storing an optimal system curve, activating the air-blowing device with a first current frequency, obtaining a first fan performance curve of the air-blowing device according to the first current frequency and a test record, obtaining a preferred efficiency of the air-blowing device by comparing the first fan performance curve with the optimal system curve, obtaining a first flow rate of the air-bowering device from the flow rate sensor, obtaining a first system curve and a first efficiency by comparing the first flow rate to the first fan performance curve, and estimating an operating efficiency of the air-blowing device by comparing the first efficiency with the preferred efficiency.

12. The system as claimed in claim 11, further comprising a pressure sensor, detecting pressure drop at an inlet port of the air-blowing device, wherein the pressure sensor is coupled with the controller and the controller controls current frequency of the air-blowing device according to the flow rate and the pressure drop.

13. A method for monitoring operating efficiency of a plurality of air-blowing devices in a ventilation system, comprising:

providing a optimal system curve;

activating the air-blowing devices with a first current frequency, obtaining a first fan performance curve of the air-blowing devices according to the first current frequency and a test record, and obtaining a preferred efficiency of the air-blowing devices by comparing the first fan performance curve with the optimal system curve;

detecting a plurality of first flow rates of the air-blowing devices;

obtaining first efficiency by comparing the first flow rates with the first fan performance curves;

estimating operating efficiency of the air-blowing devices by comparing the first efficiency with the preferred efficiency; and outputting a preferred fan performance curve and operating point.

14. The method as claimed in claim 13, wherein the optimal system curve is achieved from a predicted flow rate $Q_0$ and an predicted pressure drop $P_0$.

15. The method as claimed in claim 14, wherein the optimal system curve is achieved by following steps:

obtaining a constant K0 by substituting the predicted flow rate Q0 and the predicted pressure drop P0 into formula $P_0=K_0\times Q_0^2$; and achieving the optimal system curve from formula $P=K_0\times Q^2$, wherein P represents pressure drop and Q represents flow rate.

16. The method as claimed in claim 13, further comprising controlling activating current frequencies of the air-blowing devices to bring an operating efficiency thereof to the preferred efficiency.

17. The method as claimed in claim 13, wherein the air-blowing devices are centrifugal fans.

18. A method for monitoring operating efficiency of a plurality of air-blowing devices in a ventilation system, comprising:

providing a optimal system curve;

detecting a plurality of first flow rates of the air-blowing devices;

activating the air-blowing devices with a first current frequency, obtaining a first fan performance curve of the air-blowing devices according to the first current frequency and a test record, and obtaining a preferred efficiency of the air-blowing devices by comparing the first fan performance curve with the optimal system curve;

detecting a plurality of first pressure drops at a plurality of inlet ports of the air-blowing devices;

obtaining first efficiency by comparing the first flow rates with the first pressure drops;

estimating operating efficiency of the air-blowing devices by comparing the first efficiency with the preferred efficiency; and outputting a preferred fan performance curve and operating point.

19. The method as claimed in claim 18, wherein the optimal system curve is achieved from a predicted flow rate $Q_0$ and an predicted pressure drop $P_0$.

20. The method as claimed in claim 19, wherein the optimal system curve is achieved by following steps:

obtaining a constant K0 by substituting the predicted flow rate Q0 and the predicted pressure drop P0 into formula $P_0=K_0\times Q_0^2$; and achieving the optimal system curve from formula $P=K_0\times Q^2$wherein P represents pressure drop and Q represents flow rate.

21. The method as claimed in claim 18, further comprising controlling activating current frequencies of the air-blowing devices to bring operating efficiency thereof to the preferred efficiency.

22. The method as claimed in claim 18, wherein the air-blowing devices are centrifugal fans.

23. A system for monitoring operating efficiency of a plurality of air-blowing devices in a ventilation system, comprising:

a control box, activating the air-blowing devices;

a plurality of flow rate sensors, detecting flow rates of the air-blowing devices; and a controller, coupled with the control box and the flow rate sensors, and controlling current frequencies of the air-blowing devices according to the flow rates, wherein the controller pre-storing an optimal system curve, activating the air-blowing devices with a first current frequency, obtaining a first fan performance curve of the air-blowing devices according to the first current frequency and a test record, obtaining a preferred efficiency of the air-blowing devices by comparing the first fan performance curve with the optimal system curve, obtaining a plurality of first flow rates of the air-blowing devices from the flow rate sensors, obtaining first efficiency by comparing the first flow rates to the first fan performance curves, and estimating operating efficiency of the air-blowing devices by comparing the first efficiency with the preferred efficiency.

24. The system as claimed in claim 23, further comprising a plurality of pressure sensors, detecting pressure drops at a plurality of inlet ports of the air-blowing devices, wherein the pressure sensors are coupled with the controller and the controller controls current frequencies of the air-blowing devices according to the flow rates and the pressure drops.

* * * * *